United States Patent [19]

Eheim et al.

[11] 4,164,922

[45] Aug. 21, 1979

[54] TIMING CONTROL SYSTEM AFFORDING MAINTENANCE OF FUEL QUANITY DELIVERED

[75] Inventors: Franz Eheim, Stuttgart; Gerald Höfer, Weissach-Flacht, both of Fed. Rep. of Germany

[73] Assignee: Robert Bosch GmbH, Stuttgart, Fed. Rep. of Germany

[21] Appl. No.: 827,640

[22] Filed: Aug. 25, 1977

[30] Foreign Application Priority Data

Aug. 27, 1976 [DE] Fed. Rep. of Germany ..... 2638670

[51] Int. Cl.[2] ..... F02M 39/00

[52] U.S. Cl. ..... 123/139 AQ

[58] Field of Search ..... 123/139 AQ, 139 AP, 123/139 AD, 139 BD, 140 FP; 417/289

[56] References Cited

U.S. PATENT DOCUMENTS

| | | | |
|---|---|---|---|
| 2,813,523 | 11/1957 | Bischoff | 123/139 AP |
| 2,815,741 | 12/1957 | Fancher et al. | 123/139 AP |
| 2,869,529 | 1/1959 | Oxenfart et al. | 123/139 AQ |
| 3,486,492 | 12/1969 | Lehnerer | 123/139 AQ |
| 3,758,241 | 9/1973 | Eheim | 123/139 AP |
| 4,050,432 | 9/1977 | Davis et al. | 123/139 AQ |

*Primary Examiner*—Carlton R. Croyle
*Assistant Examiner*—Thomas I. Ross
*Attorney, Agent, or Firm*—Edwin E. Greigg

[57] ABSTRACT

A fuel injection pump for internal combustion engines in which fuel is pressurized and distributed seriatim to multiple cylinders of the engine. The fuel delivery timing, for example the timing of the onset of injection, is made variable, e.g. depending on engine speed, and the amount of fuel injected is also variable and may, in particular, also depend on engine speed. In one embodiment, the relative rotation of the fuel delivery member made for the purpose of changing the fuel timing is also imparted to the fuel magnitude control assembly which therefore undergoes no change and remains independently adjustable. Two other embodiments are also presented.

9 Claims, 5 Drawing Figures

TIMING CONTROL SYSTEM AFFORDING MAINTENANCE OF FUEL QUANITY DELIVERED

BACKGROUND OF THE INVENTION

The invention relates to fuel injection pumps for internal combustion engines in which fuel is delivered under pressure to fuel injection valves or nozzles. More particularly, the invention relates to fuel injection pumps in which a driven shaft actuates cams that drive a pump piston and which also include means for adjusting the onset of injection by changing the relative rotary position of the drive shaft of the pump and the cam drive which moves the pump piston. These fuel injection pumps also include control members which control the flow of fuel from a region of relatively low pressure to a pressure chamber connected to the injection valves.

In known fuel injection pumps of the type described above, the onset of injection is changed by shifting the portion of the drive cams which is used for fuel injection. Inasmuch as the shape of the cam surface changes drastically, especially at the beginning and end of the cam, this type of shifting also affects the fuel delivery velocity and the fuel rate and requires compensation for both of these factors to avoid substantial disadvantages. For example, if a shift to earlier injection takes place, the fuel delivery region is shifted in the direction of the onset of the cam surface, i.e., into a region of relatively more shallow cam slope, so that during a predetermined angular rotation of the drive shaft, the fuel delivery piston executes a substantially smaller stroke, thus reducing the quantity of fuel injected. This smaller quantity of fuel is being injected over an extended time period and thus reduces the fuel delivery velocity, especially at the beginning of the cam slope. Generally speaking, an advance of the injection takes place at high engine speeds where an increased injection speed is desired whereas, at low engine speeds, the injection time is preferably increased so as to reduce engine noise. The effect of the known injection advance thus completely diverges from the desired results. Furthermore, if the injection pump is intended to supply a six or eight cylinder engine for example, i.e., if six or eight cams are present on the cam plate, the spatial considerations require the slope of the cams to be relatively steep because eight separate cams may have to be located in a 360° extent of the drive shaft. In such a case, 45° would be available per cam and approximately 20° for each flank. Accordingly, nearly the entire flank must be used for fuel delivery so that a shift of the fuel delivery region can take place only within very narrow limits. Some known injection pumps, for example the simple serial pumps, are provided with shaft-driven injection adjustors which require additional cost and additional constructional space.

OBJECT AND SUMMARY OF THE INVENTION

It is thus a principal object of the invention to provide a fuel injection pump of the type generally described above in which the effective fuel delivery region with respect to the actuating cam is identically the same even when the onset of injection is shifted. It is a concurrent object of the invention to avoid all of the disadvantages inherent in known fuel injection pumps and partially recited above. Yet another object of the invention is to provide a pump with much more precise injection than previously attainable and one which is useable for engines having a large number of cylinders without requiring additional and excessively large dimensions.

The invention will be better understood as well as further objects and advantages thereof become more apparent from the ensuing detailed description of three exemplary embodiments taken in conjunction with the drawing.

DESCRIPTION OF THE PREFERRED EMBODIMENTS

Figure 1:
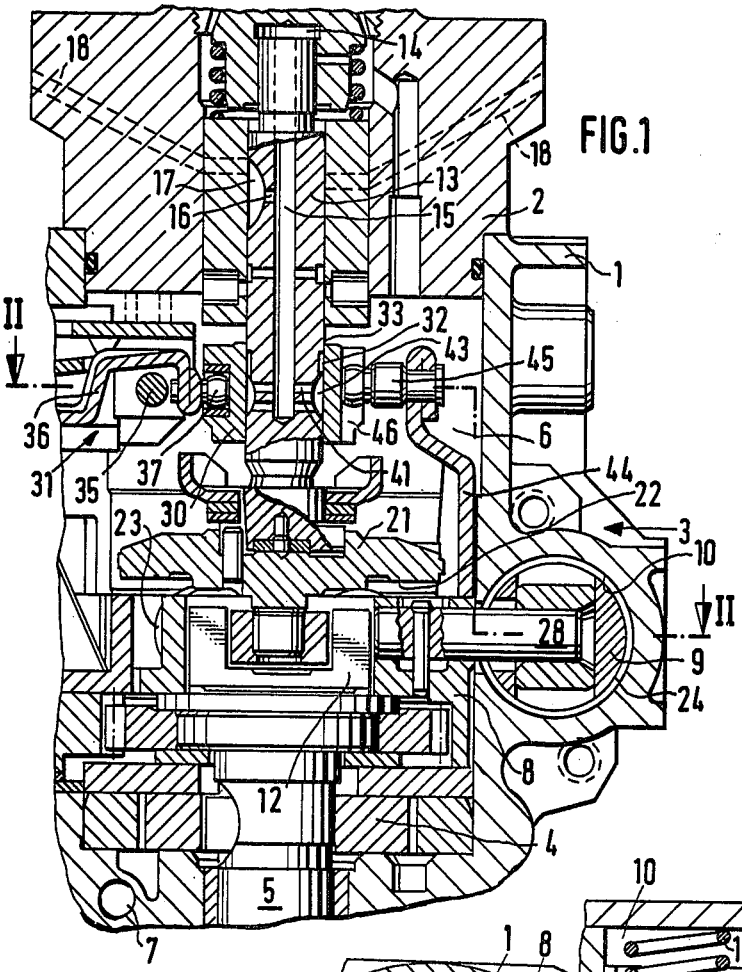
FIG. 1 is a sectional front elevational view of a first exemplary embodiment of the invention within a fuel injection pump for an eight-cylinder engine.

Common to all three embodiments are an injection pump housing 1 closed on top by a distributing assembly 2 and containing a cam drive mechanism 3 and a fuel delivery pump 4. The pump 4 is driven by a shaft 5 powered by the engine in a manner not indicated. The delivery pump 4 carries fuel from a storage container into an interior volume of the housing 1 designated as a suction chamber 6 in which it maintains a pressure which depends on engine speed (rpm) as regulated by a pressure control valve 7, indicated only schematically. The cam drive assembly 3 includes a ring 8 which may be rotated about its central axis and the periphery of which is coupled to a piston assembly 9 which moves within a cylinder 10 of the housing 1. The suction chamber 6 communicates with one end of the cylinder 10, thereby causing an rpm-dependent displacement of the piston 9 against a restoring force provided by a spring 11, thereby changing the angular position of the ring 8 by a few degrees depending on the suction chamber pressure and hence on the rpm.

A claw coupling 12 transmits the rotary power of the drive shaft 5 to a distributor assembly 13 which includes a central bore 15 which communicates with the working or pressure chamber 14 of the pump and which is continued through a radial bore 16 and a distributing groove 17 that opens communication seriatim during rotation with various pressure lines 18 which lead to the engine to provide fuel thereto, via lines not shown.

Figure 5:
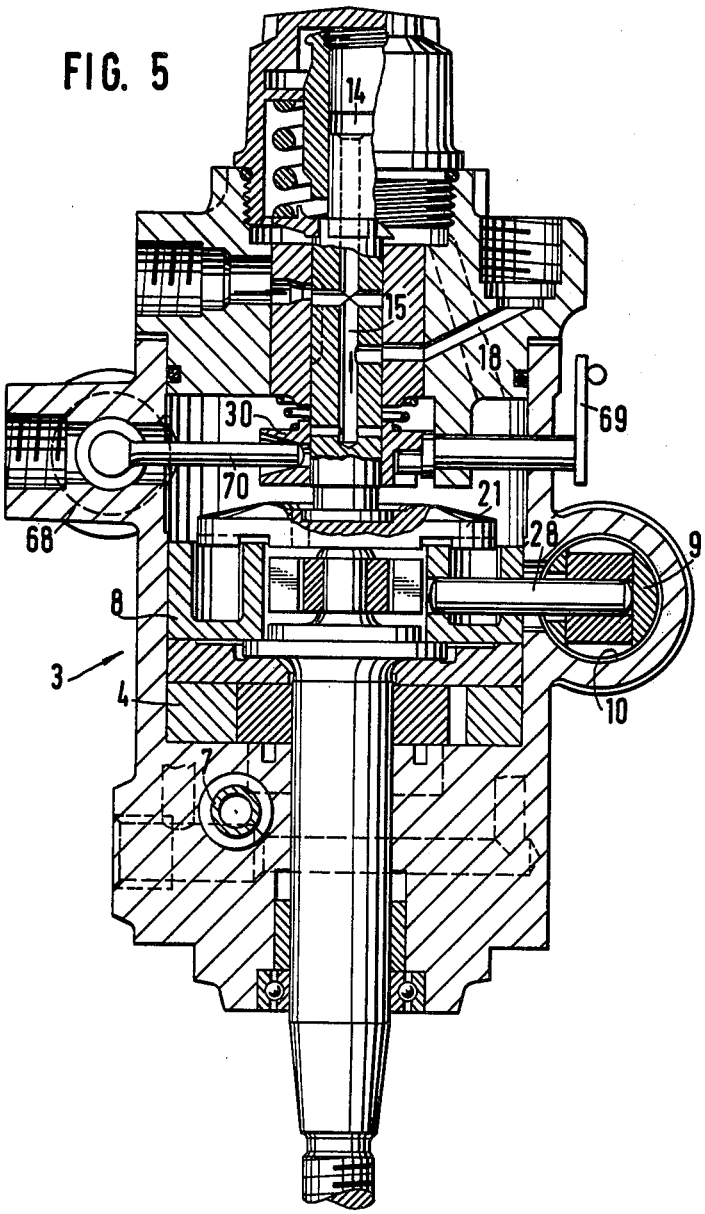
FIG. 5 is a sectional view of a third exemplary embodiment in an injection pump with hydraulic coupling of magnitude control and timing control.

In the first and third exemplary embodiments, shown respectively in FIGS. 1 and 5, the fuel distributing assembly 13 is a piston which executes simultaneously a rotating and reciprocating motion and serves, at the same time, as a pressurizing and distributing piston. The piston 13 is driven by a cam plate 21 the surface of which is provided with cams 22 which engage rollers 23 mounted in the ring 8. The number of cams 22 is equal to the number of cylinders in the engine to be supplied, for example eight cams 22 for an eight-cylinder engine. The coupler 12 is a claw which permits the cam plate 21 to execute axial reciprocating motions without interrupting the flow of rotary power from the axially immovable drive shaft 5 of the cam plate 21.

Providing communication from the suction chamber 6 to the end face 27 of the piston 9 is an annular groove 24 disposed in the cylinder 10 and a transverse bore 25 into which terminates a bore 26. When the suction chamber pressure is sufficient to displace the piston 9 against the force of the spring 11, the piston causes a bolt 28 to rotate the ring 8 carrying the rollers 23. The shift in the relative rotary position of the rollers 23 and the cam 22 thus shifts the occurrence of the reciprocating motion of the pump piston 13 with respect to the rotary position of the drive shaft 5. For example, if the ring 8 is turned against the direction of rotation of the piston 13, the delivery stroke of the pump piston will occur earlier, resulting in a so-called advance.

The amount of fuel delivered to the engine is regulated with the aid of an annular slide 30 which surrounds the pump piston coaxially and which can be moved axially by an rpm governor 31. The annular slide cooperates with at least one overflow orifice 32 in the piston 13 which communicates with the axial bore 15. The overflow orifice 32 can be opened during the upward stroke of the piston 13 after the traverse of a predetermined path, thereby terminating injection when the upper control edge 33 opens the orifice 32 and connects the pressure chamber 14 with the suction chamber 6 via the central bore 15. This type of fuel control may be called fuel termination control, i.e., the amount of fuel is regulated by shifting the end of fuel delivery while the onset of fuel delivery is always the same. It is possible however to regulate the fuel quantity by changing the onset of fuel delivery in which case the orifice 32 would be controlled by the lower edge of the annular slide 30.

Figure 2:
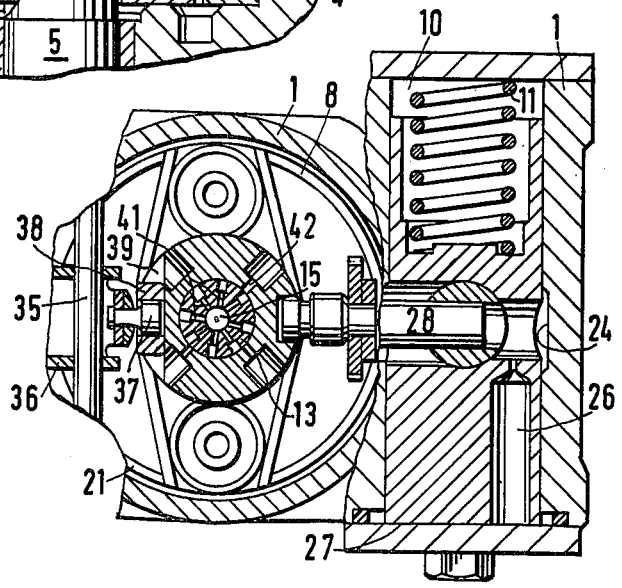
FIG. 2 is a section through the illustration of FIG. 1 along the line II—II in two different planes.

In the exemplary embodiment illustrated in FIGS. 1 and 2, the annular slide 30 is shifted axially by a mechanical rpm governor 31 which is only partially shown and which includes a pivotal shaft 35 around which rotates a lever 36 with a spherical tip 37 that engages a slot 38 in a transverse groove 39 of the annular slide 30. The slot 38 and the groove 39 permit a rotation of the annular slide 30 without changing the position of the tip 37. The governor 31 moves the annular slide 30 in the axial direction, thereby changing the effective stroke of the piston during which fuel is delivered under pressure until such time as the orifice 32 is opened by the edge 33 as already explained above. The longer the stroke of the piston until the orifice 32 is opened, the larger the amount of injected fuel. In order to provide the excess fuel quantities required for engine start-up, the annular slide 30 is displaced upwardly during engine starting so that it never opens the orifice 32 and the entire fuel quantity deliverable by the pump piston 13 is actually injected. In this first exemplary embodiment, a change of the onset of injection via the ring 8 will therefore not affect the total amount of fuel injected which, as can be appreciated, depends only on the axial position of the slide 30 and thus is pump stroke-dependent and is unchanged by the relative rotation of the reciprocating member to the rotary position of the drive shaft.

However, inasmuch as the fuel magnitude is controlled as a function of the piston stroke, the suction control, i.e., the manner in which the pressure chamber 14 is filled during the downward stroke of the piston cannot also be dependent on stroke but must be a function of the rotary position of the piston. As may be seen especially from FIG. 2, the present exemplary embodiment deals with a pump which services an eight-cylinder engine. Accordingly, the pump must open communication to fuel supply conduits on eight separate occasions during each rotation of the drive shaft 5 or the distributor 13. It is desirable if the flow cross section during suction or cylinder filling is as large as possible so as to insure complete filling of the work chamber 14 without any undesirable throttling. The fuel may be supplied through eight radial bores 41 in the distributing piston 13 which cooperate with appropriately disposed fuel supply bores 42 that are connected to the suction chamber 6. During each suction stroke of the piston, at least partial communication must be established between one of the radial bores 41 and one of the fuel supply conduits 42. As may be appreciated from FIG. 2, the angle between two radial bores 41 is relatively small. For this reason, when the fuel timing adjustment mechanism, i.e., the ring 8, is shifted by the the piston 9 and changes the synchronization of the reciprocation with respect to the rotary position of the drive shaft, the relative association of the radial bores 41 and their supply conduits 42 is also changed. Under these conditions, it has been found that in pumps supplying six or eight-cylinder engines, the amount of overlap during the suction stroke no longer suffices to adequately fill the pressure chamber of the pump. To overcome this disadvantage, the invention proposes, firstly, to locate the fuel suction control conduits within the control domain of the annular slide 30. Accordingly, the radial bores 41 terminate in axial control grooves 43 which open the supply conduits 42 during the suction stroke. The axial grooves 43 are further connected with the annular groove 32 so that the bores 41 play a role in the determination of the fuel quantity delivered. The relative overlap as between the axial grooves 43 and the supply conduits 42 during the suction stroke of the piston is maintained constant even when the fuel timing, i.e., the change of the onset of fuel delivery, is altered by a rotation of the ring 8. This is accomplished by rotating the annular slide 30 in unison with the ring 8 belonging to the cam drive assembly 3. For this purpose of unifying the motion of these two elements there is provided on the ring 8 a lever 44 having a pin 45 which engages an axial groove 46 worked into the periphery of the annular slide 30. The provision of the lever 44 neither hinders nor enhances the necessary axial motion of the annular slide but performs the necessary and synchronous rotation of the slide 30 together with the ring 8.

Figure 3:
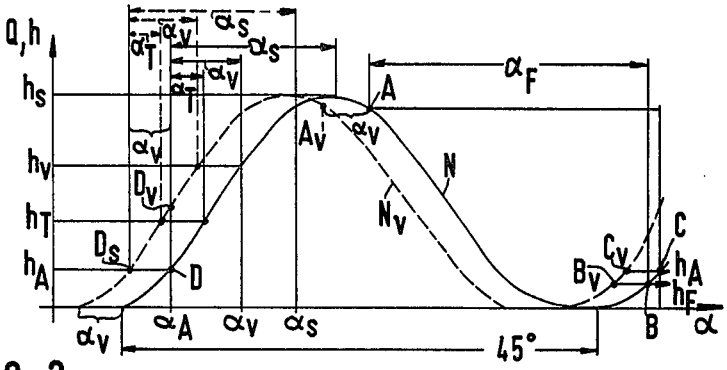
FIG. 3 is a diagram in which fuel quantity or delivery stroke is plotted against the rotational angle of the pumping element.

The simultaneous events taking place during operation of the pump are best understood with reference to a diagram as shown in FIG. 3 in which the amount of fuel Q or the piston stroke h are plotted as a function of the angle $\alpha$ of the drive shaft 5. The curve labeled N depicts the position of a point on the cam and this curve thus occupies a given total angle which is related to the number of engine cylinders. In the exemplary embodiments described here, the engine has eight cylinders so that each of the eight cams occupies a maximum of 45°. It is intended that fuel injection shall start at a piston stroke labeled $h_A$. Beginning at this point of the stroke of the piston, the fuel flow to the suction chamber 6 is interrupted. This shut-off may be performed exclusively on the basis of piston stroke but such a dependence does not suffice to adequately fill the pressure chamber of the pump and thus will not be explained in further detail. When the piston has traversed a stroke $h_T$ which would be a variable point in normal operation of the engine and would depend on the axial position of the annular slide 30, the pressure chamber 14 is relieved by establishing communication to the suction chamber 6 through one of the radial bores 41. The maximum normal piston stroke is indicated by the point $h_V$ and only when the engine is being started is it possible to supply a larger quantity, for example the maximum quantity $h_S$. The quantity of fuel delivered between the points $h_V$ and $h_S$ is the so-called starting excess which is required only during engine starting. Once the engine has attained a certain rpm, the governor 31 shuts off the excess fuel quantity, thereby limiting the fuel to the amount defined between the piston strokes $h_A$ and $h_V$. Assuming that the fuel timing mechanism, i.e., the ring 8, has now shifted the relative position of the cam plate and the drive shaft by an angle $\alpha_{VS}$, there will result a cam position curve $N_V$ shown dashed in FIG. 3. Inasmuch as the amount of fuel supplied to the engine depends entirely on the length of the stroke executed by the piston 13, the strokes which the piston makes are unchanged by this rotation as will be appreciated from an examination of the curves. As already discussed above, this is not the case with respect to the control of the suction stroke of the piston which occupies for example a total angle $\alpha_F$. The point A at which the filling of the pressure chamber 14 begins is then shifted by the angle $\alpha_{VS}$ to a point $A_V$ on the dashed curve. Accordingly, the pressure chamber 14 is connected to the suction chamber 6 at a time which, during engine starting, should still be used for supplying an excess fuel quantity. This overlap of control domains is entirely avoided by the above-described feature of the invention, namely the co-rotation of the annular slide 30 together with the ring 8 of the fuel timer by the same angle $\alpha_{VS}$. Entirely the same effect is obtained when the suction is terminated, thereby permitting the generation of pressure. The point B which designates the end of fuel suction would be shifted to the point $B_V$ thereby placing the desired onset of fuel injection $C_V$ ahead of the end of cylinder filling B. This equally undesirable state of affairs is also prevented by the co-rotation of the ring 30 and the cam plate 22.

Figure 4:
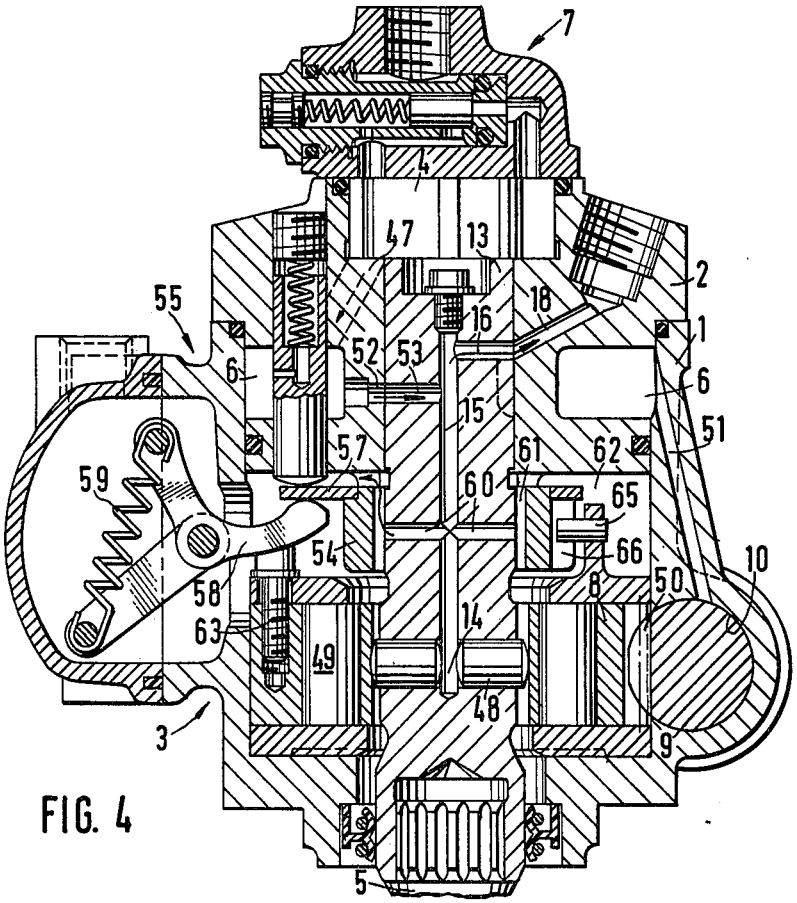
FIG. 4 is a sectional view of a radial piston injection pump.

A second exemplary embodiment of the invention is illustrated in FIG. 4 which shows relevant portions of a radial piston injection pump in which two coaxial pump pistons 48 are driven by rollers 49 actuated by cam lobes on the ring 8. The cam ring 8 is mounted in the housing 1 and is rotated by the adjustment piston 9 via peripheral gear teeth 50 which engage complementary teeth in the circumference of the ring 8. The suction chamber 6 which lies between the housing and the distributor head 2 is connected via a line 51, in a manner similar to that of the first embodiment, to the cylinder 10 in which the adjustment piston moves to thereby obtain an rpm-dependent adjustment of the ring. When the piston 9 is thus displaced by the varying pressure in the suction chamber 6, the cam ring 8 is rotated, thereby shifting the fuel delivery stroke with respect to the angular position of the drive shaft 5. The fuel is fed by the fuel delivery pump 4 with rpm-dependent pressure through a bore 47 into the suction chamber 6. During the suction strokes executed by the pump piston 48, the pressure chamber 14 communicates with the suction chamber 6 via a radial bore 52 which is connected with a radial bore 53 in the distributing member. This manner of supplying fuel is insured during each suction stroke by supplying the appropriate number of radial bores 53 and 52, only one pair of which is shown. The amount of fuel delivered during each injection stroke is determined in this example as in the previous one by an annular slide 54 which is moved axially by an rpm governor 55. In this case, the rpm governor includes a control piston 56 which is actuated hydraulically by delivery pump pressure and which exerts an axial force on a disc 57 attached to the annular slide 54. The motion of the piston 56 is opposed by a lever 58 loaded by an arbitrarily changeable spring 59. The amount of force exerted by the spring may be changed for example by being connected to the accelerator pedal of the engine. The distributing member 13 includes radial control bores 60 which cooperate with longitudinal or axial grooves 61 disposed in the inner bore of the annular slide 54. These axial grooves 61 terminate in a low pressure chamber 62, for example the suction chamber 6. Inasmuch as a radial piston pump represents a pure distribution control, the amount of fuel injected can only be controlled by a control based on rotation. Thus, if it is intended that the annular slide 54 is to perform a change in the injected quantity, then the longitudinal grooves 61 must have limiting edges which are non-parallel, i.e., mutually oblique. In the context of the present exemplary embodiment, an upward displacement of the annular slide 54 should correspond to an increase of fuel. Accordingly, the axial groove 61 must become narrower in the upward direction. It is sufficient if one or the other of the limiting edges of the axial groove 61 is oblique with respect to the central pump axis and the choice depends on whether the onset or the termination of fuel injection is to be variably controlled.

In any type of rotary control however in which the amount of fuel is controlled in dependence on the angle, the time during which it is injected with respect to the drive shaft 5 is unchanged. As seen in FIG. 3, if the cam plate is shifted by the ring 8 and piston 9 through an angle $\alpha_{VS}$, the onset of the stroke $h_A$ is shifted from the point D to the point $D_V$. Therefore, a relatively shortened remaining upward stroke of the piston would now be all that is available for any further control of the fuel quantity. Furthermore, the remaining cam surface would have a different contour than that originally available and thus would cause a change in the injection rate. Generally speaking, an advance motion of the cam plate is normally desirable during engine starting where a reduced injection rate would also be advantageous. But, as already discussed, the advance of the cam in this case results in an increase of the injection rate due to the use of the steeper cam lobe region. Therefore, the technical results are opposite to the desired conditions. It is however an object of general interest and, in particular, of the present invention, to retain the same active region of the cam lobe for fuel injection even when the onset of fuel injection, i.e., the fuel injection timing, has been shifted in radial piston pumps or, even more generally, in fuel injection pumps in which fuel quantity control is a function of the angle of rotation. This applies especially in pumps used for supplying six and eight-cylinder engines in which the angular region assigned to a single cam is relatively small and a shift of the active cam lobe region must be confined to very small limits or eliminated entirely.

Accordingly to the present invention therefore and as illustrated in the second exemplary embodiment of FIG. 4, the cam ring 8 has mounted on it a ring 64 by means of screws 63, of which only one is shown, and which provide positive connection of the two rings. The ring 64 has a tip 65 which engages a groove 66 in the periphery of the annular slide 54. The groove 66 may be oblique or parallel to the axis of the ring thereby causing axial, or both rotational and axial, motion when exposed to axial forces. In all cases however, a rotation of the cam ring 8 results in a similar rotation of the annular slide 54 and the rotation of the annular slide 54 in turn causes the point D in the curve of FIG. 3 to be shifted to the point $D_S$. Therefore, the part of the cam surface serving for injection is undisplaced as was the case in the first exemplary embodiment.

As was done in the first exemplary embodiment of FIGS. 1 and 2, it is possible in the present embodiment of FIG. 4 to displace the entire suction control assembly into the vicinity of the annular slide 54 so as to perform a similar adaptation of the suction control to the fuel timing control. Alternatively, these two elements could be two axially adjacent members. In the third and final exemplary embodiment illustrated in FIG. 5, the fuel injection quantity control is synchronized with the fuel timing control by being actuated from the same rpm-dependent pressure of the fuel supply pump as is the timing control. The fuel injection pump, whose overall construction is similar to that of the embodiment of FIG. 1, has an annular slide 30 which is rotated by a hydraulic piston 68 and which is moved axially by a lever 69 actuated by an rpm governor, not shown. The axial displacement is intended to provide fuel quantity control. The hydraulic piston 68, which is not shown in detail, experiences the fuel pressure from the supply pump 4 which is the same fuel pressure that is also provided to the timing adjusting piston 9 and its motions are coupled by a lever 70 to the annular slide 30 while permitting an independent axial displacement of the slide 30.

Within the scope of the present invention, it is possible to contemplate constructions in which, for example, the ring 30 is rotated hydraulically and is displaced axially by a pin which engages an oblique peripheral groove in such a manner that a change of the pin position also alters the axial and/or rotary position.

A principal feature of the invention is that, as illustrated in FIG. 3, a displacement of the control points which affect the quantity of injected fuel is synchronous with the shift of the cam with respect to the angular position of the drive shaft. In any case, the point D must be shifted substantially horizontally to the point $D_S$, not to the point $D_V$ as is commonly the case in pure fuel quantity control. Similar considerations apply to the control process during the suction stroke of the piston.

It is also understood that the provisions of the invention are applicable to injection pumps in which the injected fuel quantity is determined by a suction throttle. In such pumps, the onset of injection is generally determined by the amount of fuel present in the pumps working chamber while the termination of injection is constant. The manner of control is usually rotary and is always rotary in radial piston pumps so that the above remarks apply equally there. The invention may also be used for serial pumps in which a change in the cam drive causes a change in the relative association of fuel flow control and the angular position of the drive shaft.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A fuel injection pump for supplying metered quantities of fuel to an internal combustion engine, said pump including, in combination:

a housing;

a cylinder and piston assembly within said housing;

inlet and outlet means for said cylinder;

cam actuator means for providing reciprocating motion to said piston in said cylinder;

rotary drive means for said piston;

rotating shaft means for powering said cam actuator means;

means for actuating said rotating shaft means;

adjustment means for changing and adjusting the angular position of said cam actuator means with respect to said rotating shaft means, thereby changing the fuel delivery timing;

means for supplying fuel to said housing; and flow control means for controlling the flow of fuel from said housing to said cylinder; and wherein the improvement comprises:

coupler means connected to said flow control means and to said cam actuator means for maintaining the relative angular position between said flow control means and said cam actuator means when the angular position of said cam actuator means is changed for the purpose of changing the fuel delivery timing.

2. A fuel injection pump as defined by claim 1, wherein said flow control means is a rotating distributor and includes an annular slide disposed on said rotating distributor and displaced thereon axially preferably by an rpm governor, said distributor providing communication between said housing and said cylinder during the rotation of said rotating shaft, and wherein said coupler means is connected between said annular slide and said cam actuator means.

3. A fuel injection pump as defined by claim 2, wherein said adjustment means includes an adjusting piston actuated by the rpm-dependent fuel pressure from a fuel supply pump and whose motion is opposed by a restoring force and wherein said adjustment piston is coupled by said coupler means with said annular slide.

4. A fuel injection pump as defined by claim 2, wherein said adjustment means causes a rotary adjustment of said cam actuator means and wherein said coupler means transmits said rotary motion of said adjustment means to said annular slide while the axial motion of said annular slide controls the fuel quantity.

5. A fuel injection pump as defined by claim 4, wherein said annular slide is provided with a transverse groove permitting rotary motions thereof and is engaged by a lever actuated by a speed governor for providing axial motion of said annular slide.

6. A fuel injection pump as defined by claim 5, wherein said transverse groove is oblique with respect to the symmetry axis of said annular slide; whereby when said annular slide is displaced axially it also rotates.

7. A fuel injection pump as defined by claim 1, wherein said flow control means includes an annular slide disposed coaxially with respect to said piston and sliding thereon axially and wherein said flow control means includes conduits disposed within said slide cooperating with conduits in said piston, whereby fuel may be supplied to said cylinder during a suction motion of said piston.

8. A fuel injection pump as defined by claim 1, including means for drivably interconnecting said rotating shaft with said flow control means, and wherein said flow control means is said piston, means for moving said piston reciprocally whereby said piston executes simultaneous reciprocating and rotating motion powered by said rotating shaft.

9. A fuel injection pump as defined by claim 1, wherein said flow control means includes an annular slide disposed coaxially on said piston, and further includes a hydraulic piston assembly for rotating said annular slide depending on the rpm-related pressure of a fuel supply pump, and wherein said adjustment means is also engaged by the rpm-related pressure of said supply pump and further including means for the axial displacement of said annular slide to provide an adjustment of the fuel quantity delivered to said engine.

* * * * *